US006382732B1

(12) United States Patent
Tanaka et al.

(10) Patent No.: US 6,382,732 B1
(45) Date of Patent: May 7, 2002

(54) CUTTER HEAD, TUNNEL EXCAVATING MACHINE, AND CUTTER REPLACING METHOD

(75) Inventors: Junichi Tanaka; Mitsunori Tsuda, both of Kobe; Hisaya Nakada, Tokyo; Syuichi Setsukinai, Tokyo; Teizou Suzuki, Tokyo, all of (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/698,172

(22) Filed: Oct. 30, 2000

(30) Foreign Application Priority Data

Dec. 15, 1999 (JP) ..... 11-355725

(51) Int. Cl.[7] ..... E21D 9/087
(52) U.S. Cl. ..... 299/55; 299/79.1; 405/138
(58) Field of Search ..... 299/79.1, 102, 299/103, 55, 58; 405/141, 138, 144

(56) References Cited

U.S. PATENT DOCUMENTS 3,640,077 A * 2/1972 Watson et al. ..... 299/55
RE31,511 E * 1/1984 Spencer ..... 299/56
5,106,163 A * 4/1992 Fujiwara et al. ..... 299/1.3
5,547,260 A * 8/1996 Kawai et al. ..... 299/33

FOREIGN PATENT DOCUMENTS

JP U383296 8/1991
JP A6229194 8/1994

* cited by examiner

*Primary Examiner*—David Bagnell
*Assistant Examiner*—John Kreck

(57) ABSTRACT

A cutter head is rotationally drivably mounted on a front portion of a tunnel excavating machine body, a plurality of cutter spokes are provided radially on the cutter head, a plurality of mounting holes are formed in a front surface portion of each of the cutter spokes, a valve plate is turnably mounted and has through-holes formed in correspondence with the mounting holes, relay bits are mounted movably to the through-holes and the mounting holes and rearwardly withdrawably, the relay bit can be fixed by bolts at a position at which the relay bit protrudes from the front surface portion of the cutter spoke, and when the relay bit is withdrawn rearward from the mounting hole, the valve plate is turned to close the mounting hole, whereafter the relay bit is detached and can be replaced.

13 Claims, 9 Drawing Sheets

CUTTER HEAD, TUNNEL EXCAVATING MACHINE, AND CUTTER REPLACING METHOD

BACKGROUND OF THE INVENTION

1. Field of the Invention

The present invention relates to a cutter head mounted on a tunnel boring machine, a shield machine, or a vertical shaft excavating machine; a tunnel excavating machine having the cutter head applied thereto; and a cutter replacing method for replacing cutter bits mounted on the cutter head.

2. Description of Related Art

A shield excavating machine, for example, is composed of a cylindrical machine body; a rotationally drivable, disc-shaped cutter head rotatably mounted on a front portion of the machine body; many leading bits and cutter bits attached to the cutter head; many shield jacks mounted behind the cutter head for advancing the machine body, and an erector mounted behind the cutter head for assembling segments to an internal wall surface of an existing tunnel. Thus, when the shield jacks are extended while the cutter head is rotating, the machine body advances under a reaction force arising from excavation which is generated at existing segments. As a result, the leading bits and the cutter bits excavate the ground lying ahead, thereby forming a tunnel.

With such tunnel excavation work, the leading bits mounted on the cutter head scars the surface of the ground lying ahead, facilitating excavation. Then, the cutter bits excavate the ground which has become easy to excavate, and the machine body makes an advancing motion. If an unexpected obstacle, such as a sheet pile, an H-steel pile, or a reinforced concrete pile, is present in the ground ahead during excavation of a tunnel, the leading bits are unable to grind such an obstacle, and their front ends are damaged. Therefore, the customary practice is to replace the leading bits mounted on the cutter head by pile cutting bits, cut and grind the obstacle, such as the concrete pile or wood pile, by the pile cutting bits, and discharge the broken obstacle to the outside together with earth and sand.

A recent tendency toward an increase in the length of a tunnel to be excavated involves wear of leading bits and cutter bits mounted on the cutter head during excavation of the tunnel. Since worn leading bits and cutter bits cause an impairment in ground excavation efficiency, excavation operations must be halted to replace the worn bits. Conventionally, when leading bits and cutter bits are to be replaced, the ground lying ahead is stabilized by injection of a chemical liquid or by freezing. When excavation progresses to the ground-stabilized point, the excavating machine retreats, and muck is removed from inside a chamber of the machine. Then, a worker enters a space located ahead of the cutter head and within the chamber, and replaces the bits.

However, this replacement operation involves the cost of the chemical liquid used to stabilize the ground and is thus uneconomical. Furthermore, the replacement operation is time-consuming and impairs work performance. Moreover, the worker works in a narrow space, such as a space located ahead of the cutter head or a space within the chamber. Such restrictive work conditions increase a burden on the worker.

SUMMARY OF THE INVENTION

The present invention has been accomplished to solve the foregoing problems. An object of the invention is to provide a cutter head, a tunnel excavating machine, and a cutter replacing method, which make cutter bit replacement operations easy and quick to perform, thereby lessening burden imposed on workers, and improving safety and excavation work efficiency.

To achieve the above object, a first aspect of the present invention provides a cutter head comprising a rotatably mounted rotor, spokes provided radially on the rotor and each having a plurality of mounting holes provided in a column, a plurality of cutter bits mounted movably to the mounting holes of the spoke and withdrawably into the spoke, fixing means for fixing the cutter bits at positions at which front ends of the cutter bits protrude outward from the spoke, and gate means for closing the mounting hole when the cutter bit is withdrawn.

According to this configuration, the worker performs an operation for replacing the cutter bit at a rear portion of the spoke. This obviates the need to inject a chemical liquid for stabilizing the ground lying ahead, shortens the operating time, and reduces the operating cost. Moreover, the worker need not go out of the machine into a space, such as a space ahead of the cutter head or within a chamber. The burden on the worker decreases, safety can be improved, and the excavation efficiency can be raised. During replacement of the cutter bit, moreover, incursion of muddy water, etc. from the mounting hole can be inhibited by the gate means. Thus, incursion of muddy water, etc. into the spoke can be prevented reliably, and the safety of operation can be fully ensured.

In this case, the cutter bits may be leading bits protruding forward from a front surface portion of the spoke. These bits should desirably be applied when replacing worn leading bits with new ones, or when replacing the leading bits by pile cutting bits which can cut or grind an obstacle such as a concrete pile or a wood pile.

The above-mentioned fixing means may be a fastening bolt for fixing a flange portion formed in a rear end portion of the cutter bit to the spoke. To the flange portion, a pull-out bolt may be screwed, the pull-out bolt being rotated during loosening of the fastening bolt to have a front end thereof pressed against the spoke, thereby withdrawing the cutter bit from the mounting hole. Therefore, fastening and loosening operations for the cutter bit are facilitated, and the withdrawal of the cutter bit becomes easy.

The above-mentioned gate means may be a valve plate which has a through-hole in alignment with the mounting hole and allowing passage of the cutter bit, and which, when the cutter bit is withdrawn from the mounting hole, moves while retaining the cutter bit, thereby closing the mounting hole. Thus, a gate need not be provided separately, so that the structure can be simplified, and the sites of sealing are decreased in number, thus improving the sealability.

A plurality of the valve plates may be rotatably supported on a back side of the spoke. According to this arrangement, the cutter bits can be replaced per block. If one of the cutter bits touches an obstacle present in the ground lying ahead, thus bends, and becomes unwithdrawable from the mounting hole, only the affected block is unreplaceable. Hence, a decrease in the excavation efficiency, or impossibility of excavation, due to the irreplaceability of many leading bits, can be prevented. Thus, reliability can be increased.

A plurality of through-holes may be provided parallel in the valve plate, and a positioning pin for locating the valve plate at a predetermined position may be provided. Thus, a reaction force responsive to excavation that acts on the cutter bit during an excavation operation can be accepted reliably.

The positioning pin may be moved rearward to protrude, and the positioning pin may be pushed sideways to make the valve plate turnable. Thus, a turning jig for the valve plate need not be provided separately, and the valve plate can be turned easily.

The valve plate may be supported inside the spoke movably along a longitudinal direction of the spoke so that the valve plate can hold the plurality of cutter bits. Thus, a single movement of the valve plate enables many cutter bits to be replaced. The replacing operation can be performed easily and quickly to improve and the work efficiency.

The valve plate may be movable by extension and contraction motions of a jack. Thus, a turning device for the valve plate need not be provided separately, and the valve plate can be turned easily to improve the work efficiency.

A second aspect of the invention is a tunnel excavating machine comprising a cylindrical machine body, propelling jacks for advancing the machine body, a cutter head rotationally drivably mounted on a front portion of the machine body, spokes provided radially on the cutter head and each having a plurality of mounting holes provided in a column, a plurality of cutter bits mounted movably to the mounting holes of the spoke and withdrawably into the spoke, fixing means for fixing the cutter bits at positions at which front ends of the cutter bits protrude outward from the spoke, and gate means for closing the mounting hole when the cutter bit is withdrawn.

According to this configuration, the worker performs an operation for replacing the cutter bit at a rear portion of the spoke. This obviates the need to inject a chemical liquid for stabilizing the ground lying ahead, shortens the operating time, and reduces the operating cost. Moreover, the worker need not go out of the machine into a space, such as a space ahead of the cutter head or within a chamber. The burden on the worker decreases, safety can be improved, and the excavating work efficiency can be increased. During replacement of the cutter bit, moreover, incursion of muddy water, etc. from the mounting hole can be inhibited by the gate means. Thus, incursion of muddy water, etc. into the spoke can be prevented reliably, and the safety of operation can be fully ensured.

A replacement room nearly at an atmospheric pressure, where a worker can enter from the machine body and replace the cutter bit, may be provided in a rear portion of the spoke. Since the worker performs cutter replacing work in this replacement room, the worker need not go out of the machine into a space, such as a space ahead of the cutter head or within a chamber. The burden on the worker decreases, safety can be improved, and the excavating work efficiency can be increased.

The above-mentioned gate means may be a valve plate which has a through-hole in alignment with the mounting hole and allowing passage of the cutter bit, and which, when the cutter bit is withdrawn from the mounting hole, moves while retaining the cutter bit, thereby closing the mounting hole. Thus, a gate need not be provided separately, so that the structure can be simplified, and the sites of sealing are decreased in number, thus improving the sealability.

A third aspect of the invention is a cutter replacing method comprising moving a cutter bit rearward, the cutter bit being mounted in such a manner as to protrude from a front face of a cutter head, then turning a valve plate having the cutter bit supported thereon so that a cutter bit mounting hole formed in the cutter head is closed with the valve plate, replacing the cutter bit by other cutter bit in this state, then turning the valve plate again to bring the new cutter bit and the cutter bit mounting hole into alignment, and then moving the cutter bit forward and fixing the cutter bit.

According to this method, the worker performs an operation for replacing the cutter bit at a rear portion of the spoke. This obviates the need for the worker to go out of the machine into, for example, a space ahead of the cutter head or within the chamber. The burden on the worker decreases, and safety can be improved. During replacement of the cutter bit, the mounting hole is closed with the valve plate. Thus, incursion of muddy water, etc. into the interior can be inhibited. Consequently, incursion of muddy water, etc. into the spoke can be prevented reliably, and the safety of operation can be fully ensured.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Embodiments of the present invention will now be described in detail with reference to the accompanying drawings.

[First Embodiment]

Figure 1:
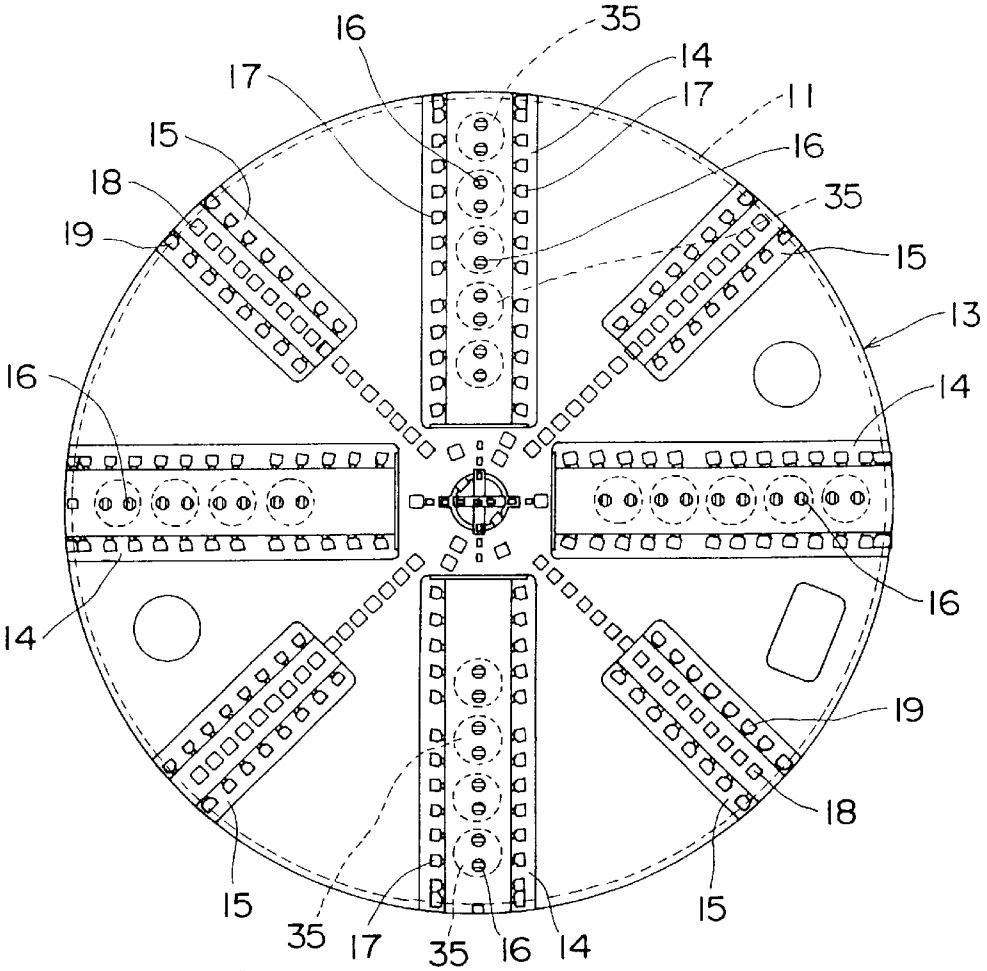
FIG. 1 is a front view of a cutter head according to a first embodiment of the present invention.
Figure 2:
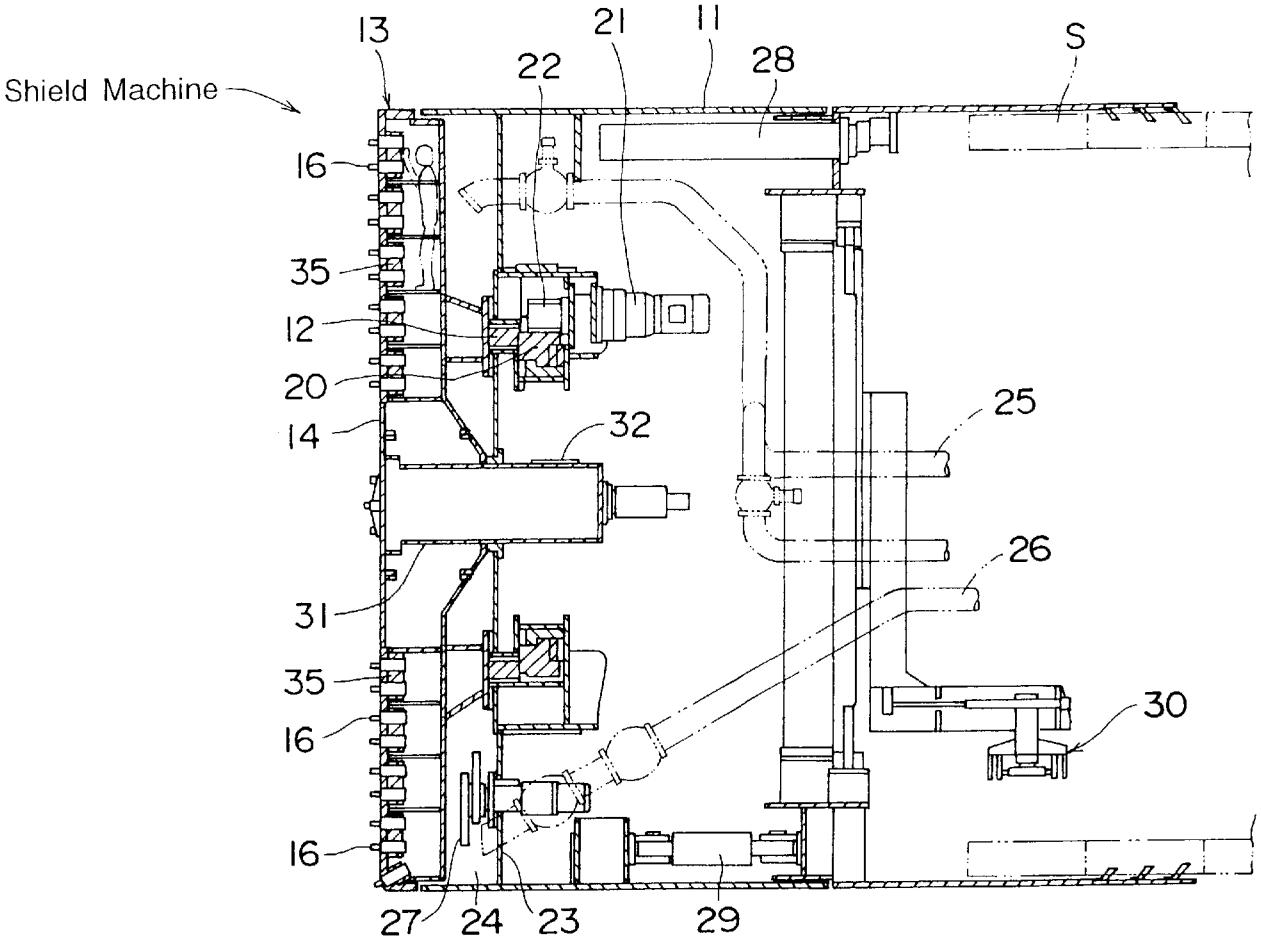
FIG. 2 is a schematic sectional view of a shield excavating machine having the cutter head of the first embodiment mounted thereon.

As shown in FIGS. 1 and 2, a shield excavating machine of the present embodiment includes a cylindrical machine body 11 composed of a front drum 11*a* and a rear drum 11*b*. A cutter head 13 is rotatably mounted on a front end portion of the machine body 11 by means of a bearing 12. Cutter spokes 14, 15 are radially attached to a front face portion of the cutter head 13. Relay bits (leading bits) 16 are mounted on a front face portion of each cutter spoke 14, while cutter bits 17 are mounted on a side portion of each cutter spoke 14. Relay bits (leading bits) 18 are attached to a front face portion of each cutter spoke 15, while cutter bits 19 are attached to a side portion of each cutter spoke 15. A ring gear 20 is fixed to a rear portion of the cutter head 13. A hydraulic motor 21 is attached to the machine body 11 such that a drive gear 22 of the hydraulic motor 21 is engaged with the ring gear 20. When the hydraulic motor 21 is driven to rotate the drive gear 22, the cutter head 13 is rotated via the ring gear 20.

A bulkhead 23 is located behind the cutter head 13 and attached to a front portion of the machine body 11, thereby defining a chamber 24 between the cutter head 13 and the bulkhead 23. A a slurry delivery pipe 25 and a slurry discharge pipe 26 extend between the chamber 24 and the exterior of the excavating machine. An agitator 27 for agitating and mixing muck and mud encountered during excavation is disposed in the vicinity of an opening of the slurry discharge pipe 26 in the chamber 24. A plurality of shield jacks 28 are circumferentially disposed along a rear inner peripheral portion of the machine body 11. The shield jacks 28 extend in a direction opposite to a direction of excavation to press against a segment S, which has been erected. The resulting reaction force causes the machine body 11 to advance. A bending jack 29 connects the front drum 11*a* and the rear drum 11*b* of the machine body 11 together. An erector 30 for erecting the segment S on an internal wall surface of a bored tunnel is disposed in a rear portion of the machine body 11.

In the so constituted shield excavating machine of the present embodiment, each of the relay bits 16 mounted on the four cutter spokes 14 on the cutter head 13 is replaceable. Assume, for example, that during excavation of a tunnel, the relay bit 16 breaks upon contact with an unexpected obstacle in the ground lying ahead, such as a sheet pile, an H-steel pile, or a reinforced concrete pile; or a front explorer detects such an obstacle in the ground lying ahead. In this case, the relay bit 16 in question can be replaced by a pile cutting bit to cut and grind the obstacle. The relay bit 16 may wear during excavation of a long tunnel, lowering the excavation efficiency. In this case, this relay bit 16 can be replaced with a new one, and an excavation operation can be continued.

In the above-described cutter head 13, each cutter spoke 14 is similarly box-shaped, and communicates with a rotating shaft 31 at the center. In a rear portion of the rotating shaft 31, a manhole 32 is formed for allowing a worker to enter from inside the machine body 11. As shown in FIGS. 3 to 6, the cutter spoke 14 is divided into a plurality of blocks, and replacement of the relay bit 16 is possible in each of the blocks. In one block of the cutter spoke 14, two (upper and lower) mounting holes 33 are formed in a front wall 14*a* of the cutter spoke 14. A circular fitting groove 34 is formed in a rear face of the front wall 14*a* in such a manner as to surround the mounting holes 33. A valve plate 35 constituting gate means has an outer peripheral front portion fitted into the fitting groove 34 via seals 36, 37, and also has an outer peripheral flange portion supported by a guide 38 fixed to the cutter spoke 14. Thus, the valve plate 35 is supported circumferentially turnably about a support shaft 39 similarly fixed to the cutter spoke 14.

In the valve plate 351 through-holes 40 are formed at positions consistent with the two mounting hole 33. At these positions of turning, the valve plate 35 is fixed to the cutter spoke 14 by means of bolts 41. The relay bit 16 comprises a blade portion 16*a* and a guide portion 16*b* integrally bonded together by a plurality of bolts 16*c*, and has a flange portion 16*d* integrally formed at a rear end of the guide portion 16*b*. The relay bit 16 is inserted into the through-hole 40 of the vale plate 35, and the mounting hole 33 of the cutter spoke 14 via packings 42. A front end of the blade portion 16*a* protrudes from a front face of the cutter spoke 14, while the flange portion 16*d* is in intimate contact with a rear face of the valve plate 35, and fixed by a plurality of bolts 43. Two bolts 44, which are screwed to the flange portion 16*d* of the relay bit 16 and whose front end contacts the rear face of the valve plate 35, are jack bolts for withdrawing the relay bit 16.

In one block of the cutter spoke 14, two (right and left) positioning depressions 45 are formed in the back face of the front wall 14*a*. In the valve plate 35, through-holes 46 are formed at positions consistent with the two positioning depressions 45. A positioning pin 47 is in the shape of a cylinder having a closed front end, and has a flange portion 47*a* and a small fitting portion 47*b* integrally formed in a rear portion thereof. The positioning pin 47 is inserted into the through-hole 46 of the vale plate 35, and the positioning depression 45 of the cutter spoke 14. The flange portion 47*a* is in intimate contact with the rear face of the valve plate 35, and fixed by a plurality of bolts 48. Two bolts 49, which are screwed to the flange portion 47*a* of the positioning pin 47 and whose front end contacts the rear face of the valve plate 35, are jack bolts for withdrawing the relay bit 16.

Next will be described a tunnel excavation operation by the so configured tunnel excavating machine, and a relay bit replacement operation.

In excavation of a tunnel (see FIGS. 1 and 2), while the cutter head 13 is being rotated by means of the hydraulic motor 21, the plurality of shield jacks 28 are extended so as to press against existing segments. The resultant reaction force causes the machine body 11 to advance. A number of relay bits 16, 18 and cutter bits 17, 19 excavate the face of the ground lying ahead. Muck is taken into the chamber 24, and discharged through the slurry discharge pipe 26 to the exterior of the machine body 11. Then, any one of the shield jacks 28 is retracted so as to form a space between the shield jack 28 and the existing segment S. A new segment S is erected in this space by use of the erector 30. This operation is repeated to excavate a tunnel having a predetermined length.

In the course of tunnel excavation in this manner, the relay bit 16 may break upon contact with an obstacle in the ground lying ahead, or an obstacle may be discovered beforehand in the ground lying ahead. In this case, the relay bit 16 needs to be replaced by a pile cutting bit (not shown) Furthermore, as a result of tunnel excavation over a long term, the relay bit 16 may wear, and may decrease in excavation efficiency. The worn relay bit must be replaced by a new one.

When the relay bit 16 is to be replaced, the cutter head 13 is rotated to upwardly position the cutter spoke 14 for the relay bit 16 to be replaced. The worker in the machine body 11 enters the cutter spoke 14 from the manhole 32 through the rotating shaft 31, and performs replacement, beginning with the relay bit 16 in the upper block. This is as shown in FIG. 2.

Figure 3:
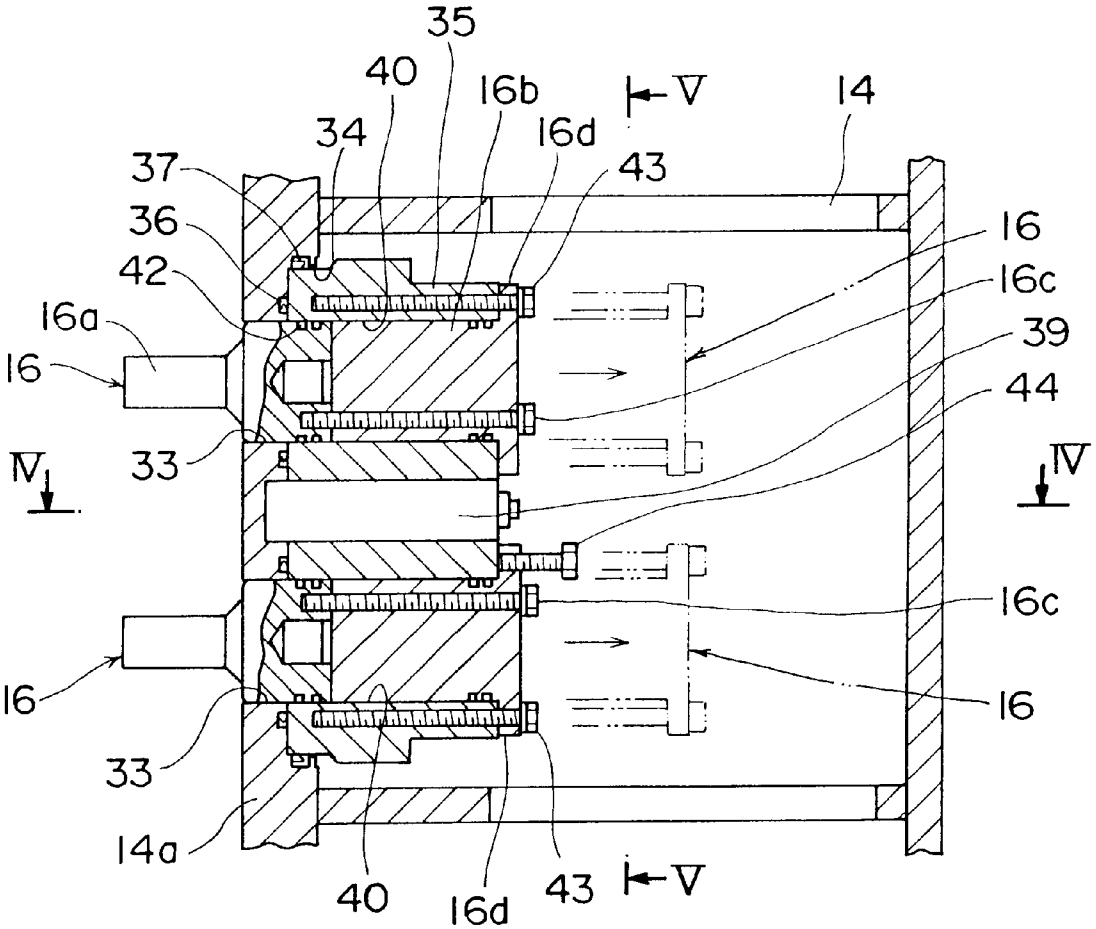
FIG. 3 is an enlarged sectional view of an essential part of FIG. 2, showing a mounted state of relay bits.
Figure 4:
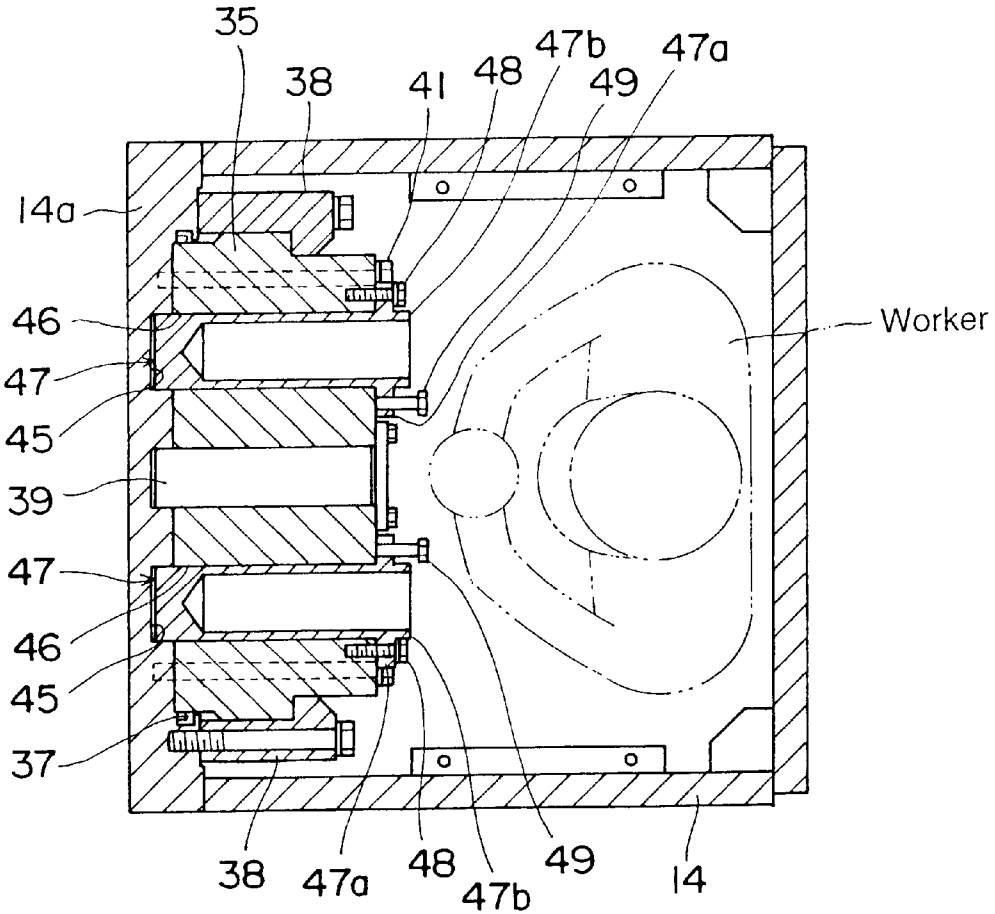
FIG. 4 is a sectional view taken along line IV—IV of FIG. 3.
Figure 5:
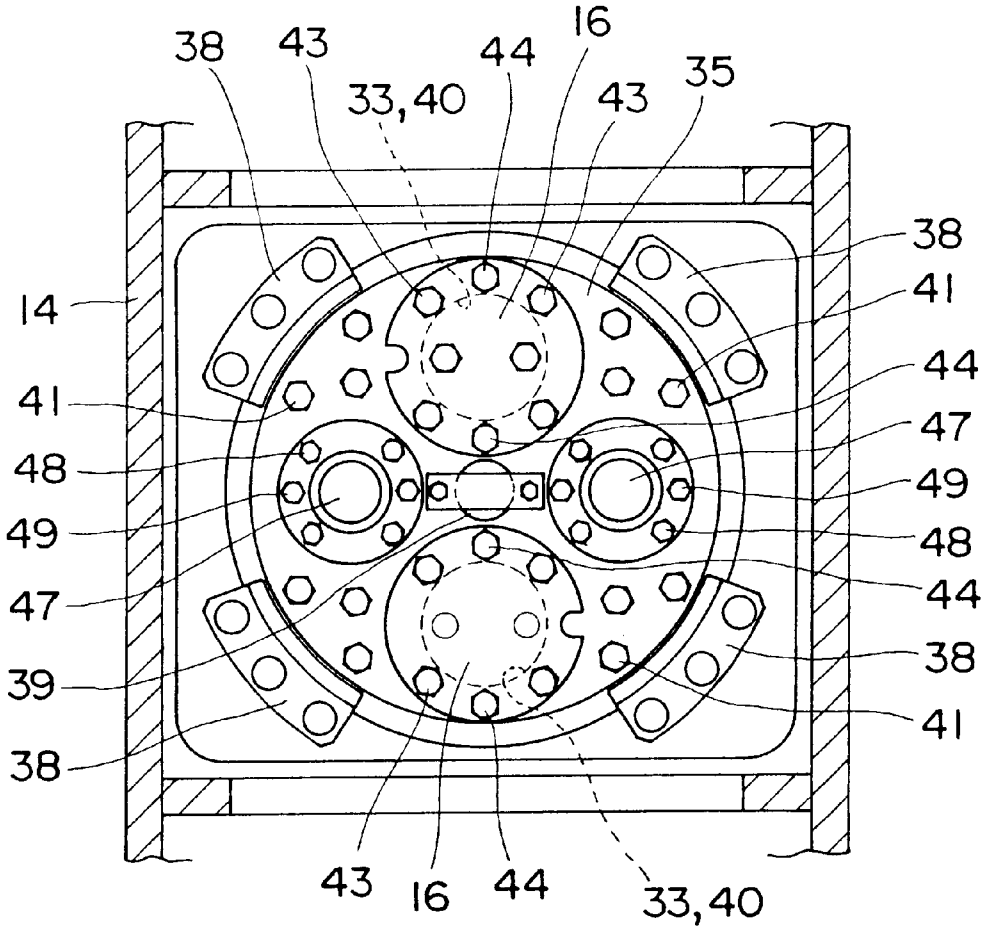
FIG. 5 is a sectional view taken along line V—V of FIG. 3.

As shown in FIGS. 3 and 4, the first step is to loosen the plurality of bolts 43, and screw in the jack bolts 44, thereby releasing the fitting between the front end portion of each relay bit 16 and the mounting hole 33 of the cutter spoke 14 through the flange portion 16*d*. The relay bit 16 is moved rearward through the through-hole 40 of the valve plate 35 with the use of a tool (not shown), and pulled out of the mounting hole 33. Then, the plurality of bolts 48 are loosened, and the jack bolts 49 are screwed in to release the fitting between the front end portion of each positioning pin 47 and the positioning depression 45 of the cutter spoke 14 through the flange portion 47*a*. The positioning pin 47 is moved rearward through the through-hole 46 of the valve plate 35 with the use of a tool (not shown), and pulled out of the through-hole 46.

Then, each positioning pin 47 that has been pulled out is inverted, whereafter the small fitting portion 47*b* is fitted into the through-hole 46 of the valve plate 35, and fastened by the bolts 48. Then, the bolts 41 are loosened to make the valve plate 35 turnable. In this state, the valve plate 35 is turned 90 degrees using a jack (not shown). In this case, for example, a base end of the jack is brought into contact with the side wall of the cutter spoke 14, and the side of the positioning pin 47 is pushed by the front end of an extended drive rod of the jack to turn the valve plate 35 through a predetermined angle. This operation is repeated several times, whereby the valve plate 35 can be turned 90 degrees.

By so turning the valve plate 35 90 degrees, the mounting holes 33 of the cutter spoke 14 are closed with the valve plate 35 and the positioning pins 47, thus preventing incursion of muddy water or mud from ahead of the cutter head 13 into the cutter spoke 14. Whether incursion of muddy water or mud is inhibited or not is checked from an inspection port (not shown) provided in the valve plate 35. After confirmation of this inhibition, the plurality of bolts 16*c* are loosened, and the guide portion 16*b* is separated from the blade portion 16*a* of the relay bit 16 and pulled out of the through-hole 33. Then, the blade portion 16*a* of the relay bit 16 is pulled out of the through-hole 33 by use of an auxiliary plate and a pull-out jack (not shown).

The withdrawn blade portion 16*a* is replaced by a blade portion of a pile cutting bit, or a blade portion of a new relay bit. The blade portion after replacement is pushed into the through-hole 33, and further the guide portion 16*b* is pushed into the through-hole 33, followed by coupling the blade portion and the guide portion together by means of the bolts 16*c*. Using a procedure performed in an order opposite to that stated earlier, the pile cutting bit or relay bit is moved to a predetermined position and fixed.

After the relay bit 16 present in an upper block of the cutter spoke 14 is replaced, the respective relay bits 16 located in blocks below the above block are replaced one after another. When all relay bits 16 or a certain relay bit 16 in one cutter spoke 14 have been or has been replaced, the cutter head 13 is turned 90 degrees at a time, and the relay bit 16 concerned is replaced where necessary.

In the shield excavating machine of the present embodiment as described above, the worker enters the cutter spoke 14, where the worker performs an operation for replacing the relay bit 16. This obviates the need to inject a chemical liquid for stabilizing the ground lying ahead, shortens the operating time, and reduces the operating cost. Moreover, the worker need not go to a space outside the machine, such as a space ahead of the cutter head or within the chamber. The burden on the worker lessens, and safety can be improved. Furthermore, the valve plate 35 is turnably supported on the cutter spoke 14, and the relay bits 16 are supported on the valve plate 35. Thus, during replacement of the cutter bits 16, the valve plate 35 inhibits the incursion of muddy water, etc. from the mounting holes 33. Consequently, incursion of muddy water, etc. into the cutter spoke 14 can be prevented reliably, and the safety of operation can be fully ensured. Besides, the valve plate 35 supporting the relay bits 16 is used as gate means for closing the mounting hole 33 of the cutter spoke 14 when the relay bit 16 is pulled out rearward. Thus, a gate need not be provided separately, so that the structure can be simplified, and the sealability can be improved.

In the foregoing embodiment, the valve plate 35 is turnably supported on the cutter spoke 14 by the fitting groove 34, guide 38, and support shaft 39. However, any one of these support members is sufficient.

[Second Embodiment]

Figure 6:
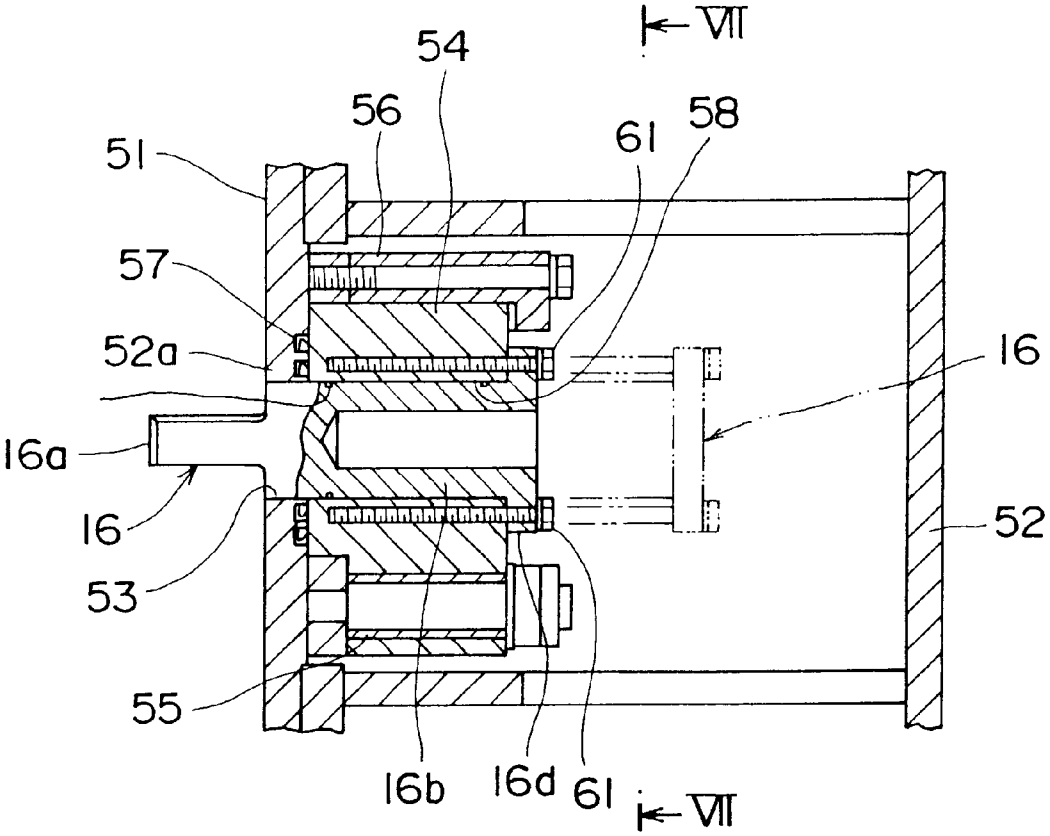
FIG. 6 is a vertical sectional view of a cutter spoke in a cutter head according to a second embodiment of the present invention.
Figure 7:
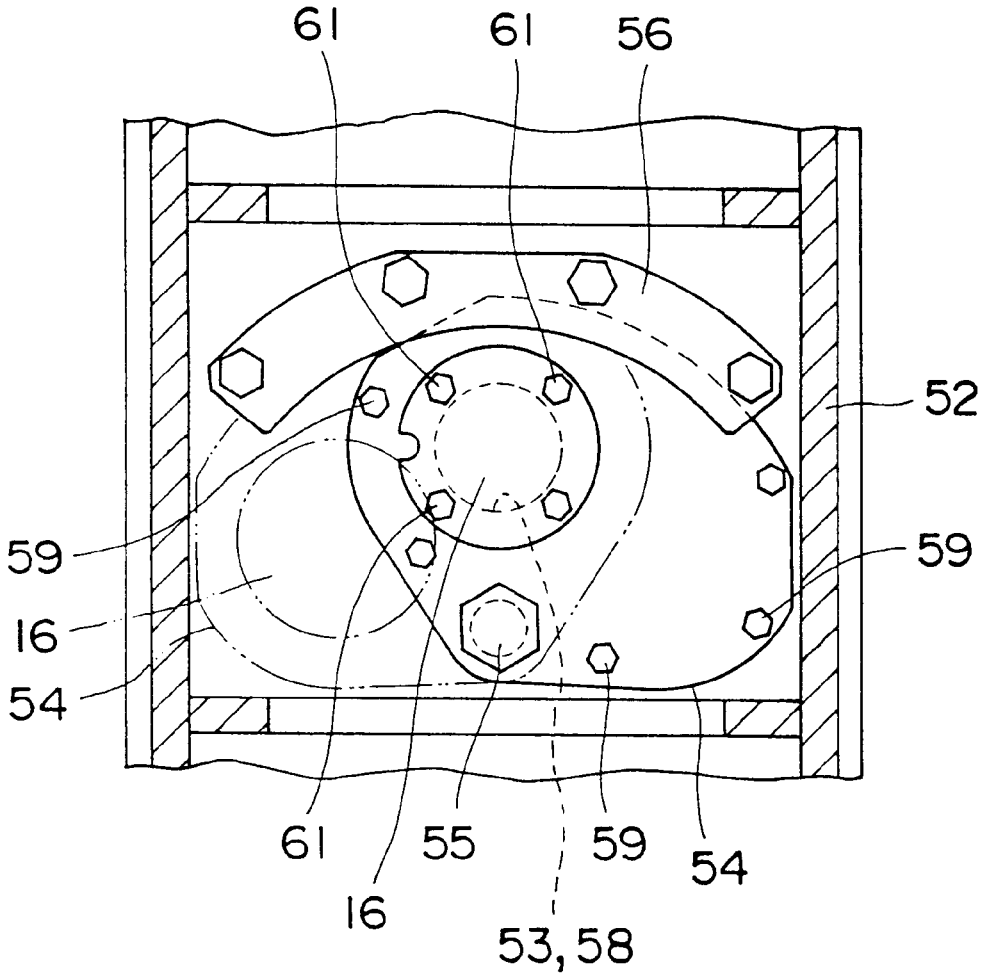
FIG. 7 is a sectional view taken along line VII—VII of FIG. 6.

As FIGS. 6 and 7 show, in a cutter head 51 of the present embodiment, each cutter spoke 52 is box-shaped, and divided into a plurality of blocks, and replacement of the relay bit 16 is possible in each of the blocks. In one block of the cutter spoke 52, a mounting hole 53 is formed at a center of a front wall 52*a*. A valve plate 54 constituting gate means is fan-shaped, and has a base end portion attached turnably on a support shaft 55 fixed to the cutter spoke 52, and also has an outer peripheral portion supported by a guide 56 fixed to the cutter spoke 52. Because of this configuration, the valve plate 54 is supported turnably about the support shaft 55 as a fulcrum. A seal 57 is mounted between the front wall 52*a* of the cutter spoke 52 and the valve plate 54.

In the valve plate 54, a through-hole 58 is formed at a position consistent with the mounting hole 53. At this position of turning, the valve plate 54 is fixed to the cutter spoke 52 by means of bolts 59. The relay bit 16 is inserted into the through-hole 58 of the valve plate 54 and the mounting hole 53 of the cutter spoke 52 via an O-ring 60. A front end of a blade portion 16*a* of the relay bit 16 protrudes from a front face of the cutter spoke 52, while a flange portion 16*d* of the relay bit 16 is in intimate contact with a rear face of the valve plate 54, and fixed by a plurality of bolts 61.

When the relay bit 16 is to be replaced, the cutter head 51 is rotated to upwardly position the cutter spoke 52 for the relay bit 16 to be replaced. The plurality of bolts 61 are loosened, and jack bolts (not shown) are screwed in, thereby releasing the fitting between the front end portion of each relay bit 16 and the mounting hole 53 of the cutter spoke 52 through the flange portion 16*d*. The relay bit 16 is moved rearward through the through-hole 58 of the valve plate 54, and pulled out of the mounting hole 53. Then, the valve plate 54 is turned about 60 degrees using a jack (not shown) By so doing, the mounting hole 53 of the cutter spoke 52 is closed with the valve plate 54, thus preventing incursion of muddy water or mud from ahead of the cutter head 51 into the cutter spoke 52. Then, the guide portion 16*b* and blade portion 16*a* of the relay bit 16 are sequentially pulled out of the through-hole 58 in the same manner as in the preceding embodiment.

The withdrawn blade portion 16*a* is replaced by a blade portion of a pile cutting bit, or a blade portion of a new relay bit. Using a procedure performed in an order opposite to that stated earlier, the pile cutting bit or the new relay bit is moved to a predetermined position and fixed.

In the cutter head 51 of the present embodiment, one relay bit 16 is detachably mounted in one block of the cutter spoke 52. If one relay bit 16 bends upon contact with an obstacle in the ground lying ahead, and the blade portion 16*a* becomes unwithdrawable from the mounting hole 53 of the cutter spoke 52, only this single relay bit 16 affected is unreplaceable. Hence, a decrease in the excavation efficiency, or impossibility of excavation, due to the inability to replace many relay bits 16, can be prevented. Thus, reliability can be increased.

In each of the above embodiments, the valve plate 35 or 54 was turned by a jack which the worker brought into the cutter spoke. However, the jack may be mounted at a predetermined position beforehand. Moreover, the means of turning the valve plate 35 or 54 is not restricted to a jack, but may be a drive motor or the like.

[Third Embodiment]

Figure 8:
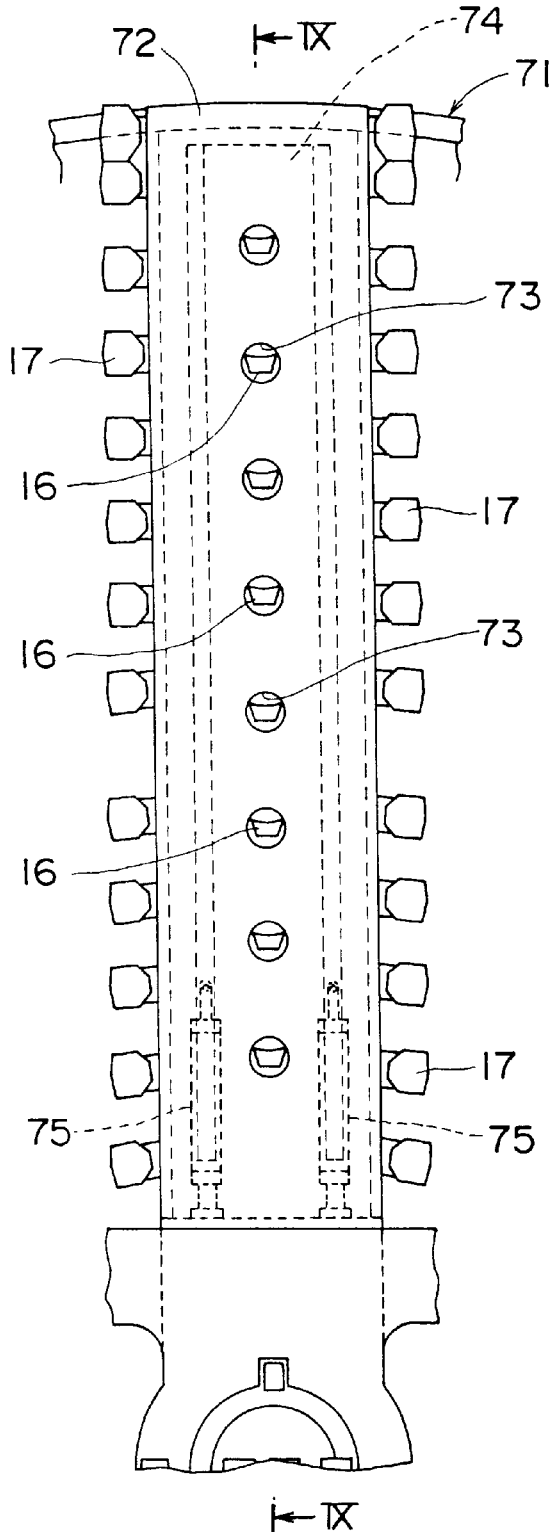
FIG. 8 is a front view of a cutter spoke in a cutter head according to a third embodiment of the present invention.
Figure 9:
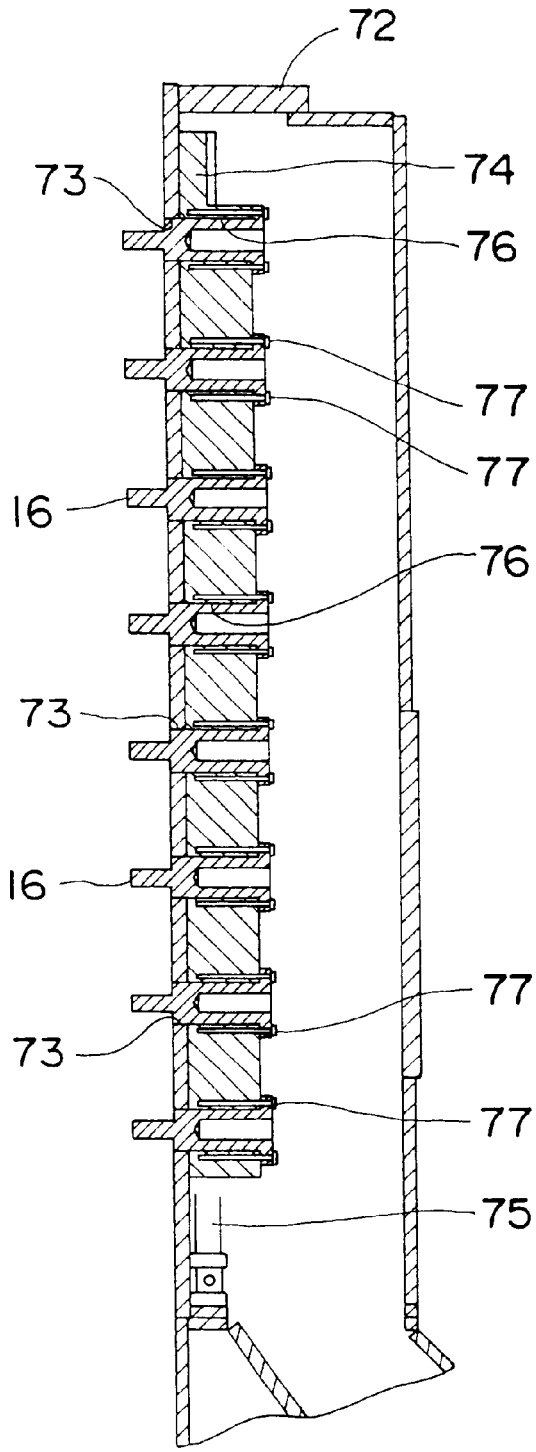
FIG. 9 is a sectional view taken along line IX—IX of FIG. 8.

As FIGS. 8 and 9 show, in a cutter head 71 of the present embodiment, each cutter spoke 72 is box-shaped. In a front wall 72*a* of the cutter spoke 72, a plurality of mounting holes 73 are formed at equal intervals in a longitudinal direction. A valve plate 74 constituting gate means is rod-shaped, and is supported in the cutter spoke 72 movably along a longitudinal direction of the cutter spoke 72. The valve plate 74 is movable by a pair of hydraulic jacks 75. In the valve plate 74, a plurality of through-holes 76 are formed at positions consistent with the mounting holes 73. At these positions of movement, the valve plate 74 is fixed to the cutter spoke 72 by means of bolts (not shown). The relay bit 16 is inserted into the through-hole 76 of the valve plate 74 and the mounting hole 73 of the cutter spoke 72. A front end of a blade portion 16*a* of the relay bit 16 protrudes from a front face of the cutter spoke 72, while a flange portion 16*d* of the relay bit 16 is in intimate contact with a rear face of the valve plate 74, and fixed by a plurality of bolts 77.

When the relay bit 16 is to be replaced, the cutter head 71 is rotated to upwardly position the cutter spoke 72 for the relay bit 16 to be replaced. The plurality of bolts 77 are loosened, and jack bolts (not shown) are screwed in, thereby releasing the fitting between the front end portion of each relay bit 16 and the mounting hole 73 of the cutter spoke 72. The relay bit 16 is moved rearward through the through-hole 76 of the valve plate 74, and pulled out of the mounting hole 73. Then, the hydraulic jacks 75 are contracted to move the valve plate 74 toward the center of the cutter head 71. By so doing, the mounting holes 73 of the cutter spoke 72 are closed with the valve plate 74, thus preventing incursion of muddy water or mud from ahead of the cutter head 71 into the cutter spoke 72. Then, the guide portion 16*b* and blade portion 16*a* of the relay bit 16 are sequentially pulled out of the through-hole 76 in the same manner as in the preceding embodiment.

The withdrawn blade portion 16*a* is replaced by a blade portion of a pile cutting bit, or a blade portion of a new relay bit. Using a procedure performed in an order opposite to that stated earlier, the pile cutting bit or the new relay bit is moved to a predetermined position and fixed.

In the cutter head 71 of the present embodiment, one valve plate 74 is supported movably along the longitudinal direction of the cutter spoke 72. On one of its block, many relay bits 16 are detachably mounted. Single movement of the valve plate 74 enables all the relay bits 16 to be replaced. An replacement operation can be performed easily and in a short time.

In each of the above embodiments, the valve plates 35, 54, 74 were used as gate means for closing the mounting holes 33, 53, 73 of the cutter spokes 14, 52, 72 when the relay bit 16 is pulled out rearward. However, plate-shaped gates for closing the mounting holes 33, 53, 73 may be provided between the cutter spokes 14, 52, 72 and the valve plates 35, 54, 74.

While the present invention has been described in the foregoing fashion, it is to be understood that the invention is not limited thereby, but may be varied in many other ways. Such variations are not to be regarded as a departure from the spirit and scope of the invention, and all such modifications as would be obvious to one skilled in the art are intended to be included within the scope of the appended claims.

What is claimed is:

1. A cutter head comprising:

a rotatably mounted rotor;

spokes provided radially on the rotor and each having a plurality of mounting holes provided in a column;

a plurality of cutter bits mounted movably to the mounting holes of the spoke and withdrawably into the spoke;

fixing means for fixing the cutter bits at positions at which front ends of the cutter bits protrude outward from the spoke; and gate means for closing the mounting hole when the cutter bit is withdrawn.

2. The cutter head of claim 1, wherein:

the cutter bits are leading bits protruding forward from a front surface portion of the spoke.

3. The cutter head of claim 1, wherein:

the fixing means is a fastening bolt for fixing a flange portion formed in a rear end portion of the cutter bit to the spoke; and a pull-out bolt is screwed to the flange portion, the pull-out bolt being rotated during loosening of the fastening bolt to have a front end thereof pressed against the spoke, thereby withdrawing the cutter bit from the mounting hole.

4. The cutter head of claim 1, wherein:

the gate means is a valve plate which has a through-hole in alignment with the mounting hole and allowing passage of the cutter bit, and which, when the cutter bit is withdrawn from the mounting hole, moves while retaining the cutter bit, thereby closing the mounting hole.

5. The cutter head of claim 4, wherein:

the valve plate is supported inside the spoke movably along a longitudinal direction of the spoke so that the valve plate can hold the plurality of cutter bits.

6. The cutter head of claim 4, wherein:

the valve plate is movable by extension and contraction motions of a jack.

7. The cutter head of claim 1, wherein:

a plurality of the valve plates are rotatably supported on a back side of the spoke.

8. The cutter head of claim 7, wherein:

a plurality of through-holes are provided parallel in the valve plate; and a positioning pin for locating the valve plate at a predetermined position is provided.

9. The cutter head of claim 8, wherein:

the positioning pin is moved rearward to protrude, and the positioning pin is pushed sideways to make the valve plate turnable.

10. A tunnel excavating machine comprising:

a cylindrical machine body;

propelling jacks for advancing the machine body;

a cutter head rotationally drivably mounted on a front portion of the machine body;

spokes provided radially on the cutter head and each having a plurality of mounting holes provided in a column;

a plurality of cutter bits mounted movably to the mounting holes of the spoke and withdrawably into the spoke;

fixing means for fixing the cutter bits at positions at which front ends of the cutter bits protrude outward from the spoke; and gate means for closing the mounting hole when the cutter bit is withdrawn.

11. The tunnel excavating machine of claim 10, wherein:

a replacement room nearly at an atmospheric pressure, where a worker can enter from the machine body and replace the cutter bit, is provided in a rear portion of the spoke.

12. The tunnel excavating machine of claim 10, wherein:

the gate means is a valve plate which has a through-hole in alignment with the mounting hole and allowing passage of the cutter bit, and which, when the cutter bit is withdrawn from the mounting hole, moves while retaining the cutter bit, thereby closing the mounting hole.

13. A cutter replacing method comprising:

moving a cutter bit rearward, the cutter bit being mounted in such a manner as to protrude from a front face of a cutter head;

then turning a valve plate having the cutter bit supported thereon so that a cutter bit mounting hole formed in the cutter head is closed with the valve plate;

replacing the cutter bit by other cutter bit in this state;

then turning the valve plate again to bring the new cutter bit and the cutter bit mounting hole into alignment; and then moving the cutter bit forward and fixing the cutter bit.

* * * * *